US012185807B1

(12) United States Patent
Frank

(10) Patent No.: US 12,185,807 B1
(45) Date of Patent: Jan. 7, 2025

(54) STATIONERY SYSTEM

(71) Applicant: Rashida Frank, Wellington, FL (US)

(72) Inventor: Rashida Frank, Wellington, FL (US)

( * ) Notice: Subject to any disclaimer, the term of this patent is extended or adjusted under 35 U.S.C. 154(b) by 9 days.

(21) Appl. No.: 18/103,907

(22) Filed: Jan. 31, 2023

Related U.S. Application Data

(60) Provisional application No. 63/305,380, filed on Feb. 1, 2022.

(51) Int. Cl.

| | |
|---|---|
| ***A45C 11/34*** | (2006.01) |
| *A45C 11/00* | (2006.01) |
| *A45C 13/00* | (2006.01) |
| *A45C 13/10* | (2006.01) |

(52) U.S. Cl.
CPC ..... *A45C 11/34* (2013.01); *A45C 2011/003* (2013.01); *A45C 13/005* (2013.01); *A45C 13/1069* (2013.01)

(58) Field of Classification Search
CPC ... A45C 11/34; A45C 13/005; A45C 13/1069; A45C 2011/003
USPC ..... 206/214
See application file for complete search history.

(56) References Cited

U.S. PATENT DOCUMENTS

| | | | | |
|---|---|---|---|---|
| 432,831 | A | 7/1890 | Legge | |
| 924,406 | A | 6/1909 | Walker | |
| 2,228,493 | A | 1/1941 | Ilah | |
| 2,657,669 | A | 11/1953 | Roger | |
| 2,857,881 | A | 10/1958 | Beebe | |
| D327,293 | S | 6/1992 | Isak | |
| 5,430,952 | A * | 7/1995 | Betts | G01B 3/1084 33/760 |
| 5,441,149 | A | 8/1995 | Willard et al. | |
| D382,009 | S | 8/1997 | Miller, Jr. | |
| 6,021,891 | A | 2/2000 | Anderson | |
| 6,857,518 | B2 | 2/2005 | Chao | |
| 6,981,593 | B1 | 1/2006 | Klodt | |
| D570,099 | S | 6/2008 | Bhavnani | |
| 7,591,037 | B1 * | 9/2009 | Strickland | B26B 11/00 7/156 |
| 8,402,583 | B1 * | 3/2013 | Bebber | B26B 11/00 7/125 |
| 8,545,285 | B2 | 10/2013 | Fernandes | |
| 9,364,062 | B2 | 6/2016 | Stukenkemper | |
| D879,462 | S | 3/2020 | Si | |

(Continued)

FOREIGN PATENT DOCUMENTS

| | | | |
|---|---|---|---|
| JP | 3017689 | U | 10/1995 |
| KR | 200342669 | Y1 | 9/2003 |
| KR | 20100007520 | U | 7/2010 |

*Primary Examiner* — Jacob K Ackun
(74) *Attorney, Agent, or Firm* — John Rizvi; John Rizvi, P.A.—The Patent Professor®

(57) ABSTRACT

An all-in-one stationery system that includes a first cover, a second cover, a calculator, and a sharpener. The first cover and the second cover are rotatably connected with each other and toggled between an open configuration and a closed configuration. While the stationery system is in an open configuration, the stationery system can be used as a long ruler. Alternatively, when the stationery system is in a closing configuration, the stationery system can be used as a container and/or a short ruler. The calculator of the stationery system is mounted on the first or second cover, and the sharpener is mounted on either the first or second cover opposite the calculator.

20 Claims, 9 Drawing Sheets

(56) References Cited

U.S. PATENT DOCUMENTS

| | | | | |
|---|---|---|---|---|
| 2008/0023581 | A1* | 1/2008 | Sandy | B43M 7/007 242/600 |
| 2008/0142401 | A1* | 6/2008 | Trannon | A45C 13/02 206/553 |
| 2011/0180544 | A1 | 7/2011 | Frank | |
| 2013/0118926 | A1 | 5/2013 | Jin | |
| 2015/0128666 | A1* | 5/2015 | Thomson | E05B 65/5284 70/67 |
| 2020/0029665 | A1 | 1/2020 | Zhou | |
| 2020/0187616 | A1 | 6/2020 | Song | |
| 2020/0196724 | A1 | 6/2020 | Higuchi | |
| 2020/0214412 | A1 | 7/2020 | Bartelme et al. | |

* cited by examiner

STATIONERY SYSTEM

CROSS-REFERENCE TO RELATED APPLICATIONS

This application claims the benefit of U.S. Provisional Patent Application Ser. No. 63/305,380, filed on Feb. 1, 2022, which is incorporated herein in its entirety.

FIELD OF THE INVENTION

The present invention relates generally to a stationery system, and more particularly, to an all-in-one stationery system.

BACKGROUND OF THE INVENTION

A ruler can be defined as a tool or device used to measure length and draw straight lines. A ruler can be used to measure lengths in both metric, inch and customary units. A ruler may be marked in centimeters (cm) along the top and inches (in) along the bottom. To measure the length of an object, place the zero hashmark of the ruler exactly along one end of the object. Align the object to be measured along the edge of the ruler. Note the hashmark on the ruler along which the other side of the object ends. Knowing how to read a ruler is important, not just for school but also for daily life. For example, if it is needed to make something out of construction paper, one would likely need to use a ruler to measure out how much of the needed material. Or what if it is needed to frame a photo, in this case, one might have to measure the picture to see what kind of frame it would fit in.

A pencil is a writing or drawing implement with a solid pigment core encased in a sleeve, barrel, or shaft that prevents breaking the core or marking a user's hand. Pencils create marks by physical abrasion, leaving a trail of solid core material that adheres to a sheet of paper or other surface. They are distinct from pens, which dispense liquid or gel ink onto the marked surface. Most pencil cores are made of graphite powder mixed with a clay binder. Graphite pencils (traditionally known as "lead pencils") produce grey or black marks that are easily erased, but otherwise resistant to moisture, most chemicals, ultraviolet radiation and natural aging. Other types of pencil cores, such as those of charcoal, are mainly used for drawing and sketching. Coloured pencils are sometimes used by teachers or editors to correct submitted texts, but are typically regarded as art supplies, especially those with cores made from wax-based binders that tend to smear when erasers are applied to them. Grease pencils have a softer, oily core that can leave marks on smooth surfaces such as glass or porcelain. The most common pencil casing is thin wood, usually hexagonal in section but sometimes cylindrical or triangular, permanently bonded to the core. Casings may be of other materials, such as plastic or paper. To use the pencil, the casing must be carved or peeled off to expose the working end of the core as a sharp point. Mechanical pencils have more elaborate casings which are not bonded to the core; instead, they support separate, mobile pigment cores that can be extended or retracted (usually through the casing's tip) as needed. These casings can be reloaded with new cores (usually graphite) as the previous ones are exhausted.

A pencil sharpener is a tool for sharpening a pencil's writing point by shaving away its worn surface. Pencil sharpeners may be operated manually or by an electric motor. It is common for many sharpeners to have a casing around them, which can be removed for emptying the pencil shavings debris into a rubbish/trash bin.

An eraser is an article of stationery that is used for removing marks from paper or skin (e.g. parchment or vellum). Erasers have a rubbery consistency and come in a variety of shapes, sizes and colors. Some pencils have an eraser on one end. Less expensive erasers are made from synthetic rubber and synthetic soy-based gum, but more expensive or specialized erasers are made from vinyl, plastic, or gum-like materials. At first, erasers were invented to erase mistakes made with a pencil; later, more abrasive ink erasers were introduced. The term is also used for things that remove marks from chalkboards and whiteboards.

An electronic calculator is typically a portable electronic device used to perform calculations, ranging from basic arithmetic to complex mathematics. Modern electronic calculators vary from cheap, give-away, credit-card-sized models to sturdy desktop models with built-in printers.

A stationery case or stationery box is a container used to store stationery. A stationery case can also contain a variety of other stationery such as sharpeners, pens, glue sticks, erasers, scissors, rulers and calculators. Stationery cases can be made from a variety of materials such as wood or metal. Some stationery cases have a hard and rigid shell encasing the pens inside, while others use a softer material such as plastic, leather or cotton. Soft versions are typically fastened with a zipper. The intent of having a stationery case is for easy portability of small items such as pencils. They may also contain other stationery such as pens, glue sticks and staplers. Some stationery cases double as make up bags. Early stationery cases were round or cylindrical in shape.

However, no stationery case has built-in sharpeners and calculators. Accordingly, there is need for a solution to at least one of the aforementioned problems.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention is directed toward a stationery system, and more particularly, to an all-in-one stationery system.

In an embodiment of the present invention, the stationery system comprises a first cover and a second cover.

In this embodiment of the present invention, the first cover and the second cover are rotatably connected with each other.

In this aspect of this embodiment of the present invention, a terminal end of the first cover and a terminal of the second cover are rotatably connected with each other.

In this embodiment of the present invention, the stationery system is selectively in an open configuration, a folding configuration and a closing configuration.

In this embodiment of the present invention, when the stationery system is in the open configuration, the stationery system can be used as a longer ruler.

In this embodiment of the present invention, when the stationery system is in the closing configuration, the stationery system can be used as a container and/or a shorter ruler.

In this embodiment of the present invention, the first cover and the second cover each comprises marks and numbers formed or printed on lateral sides and/or outer sides thereof.

In this embodiment of the present invention, at least one of the first cover and the second cover comprises at least one groove or cavity formed on an inner side thereof.

In this embodiment of the present invention, at least one of the first cover and the second cover further comprises at least one sheet or plate, and the at least one sheet or plate removably covers the at least one groove or cavity.

In this embodiment of the present invention, the stationery system further comprises a calculator.

In this embodiment of the present invention, the calculator is mounted on at least one of the first cover and the second cover.

In this embodiment of the present invention, the stationery system further comprises a sharpener.

In this embodiment of the present invention, the sharpener is mounted on at least one of the first cover and the second cover.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

These and other objects, features, and advantages of the present invention will become more readily apparent from the attached drawings and the detailed description of the preferred embodiments, which follow.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

The preferred embodiments of the invention will hereinafter be described in conjunction with the appended drawings provided to illustrate and not to limit the invention, where like designations denote like elements, and in which:

Figure 1:
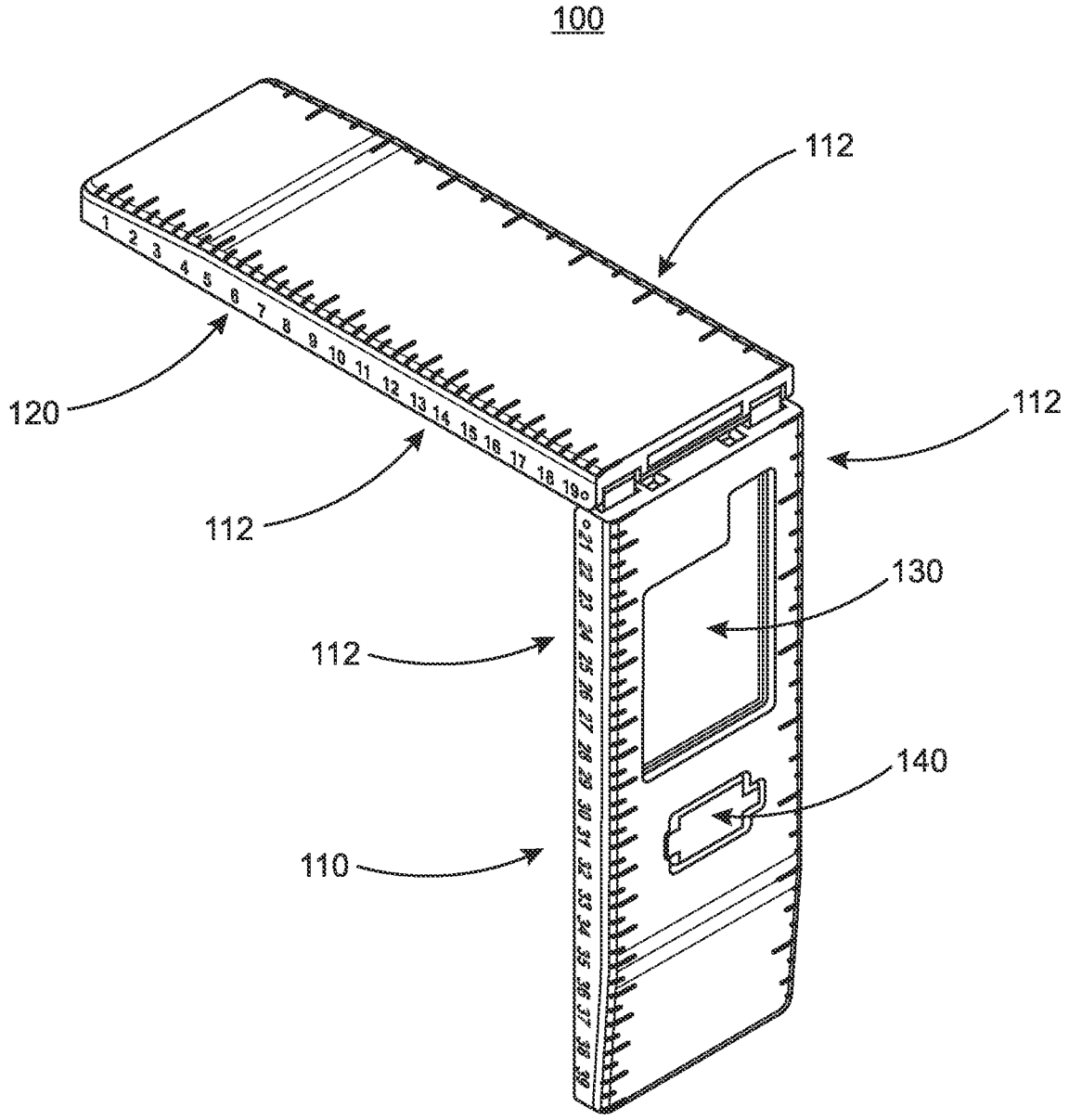
Figure 2:
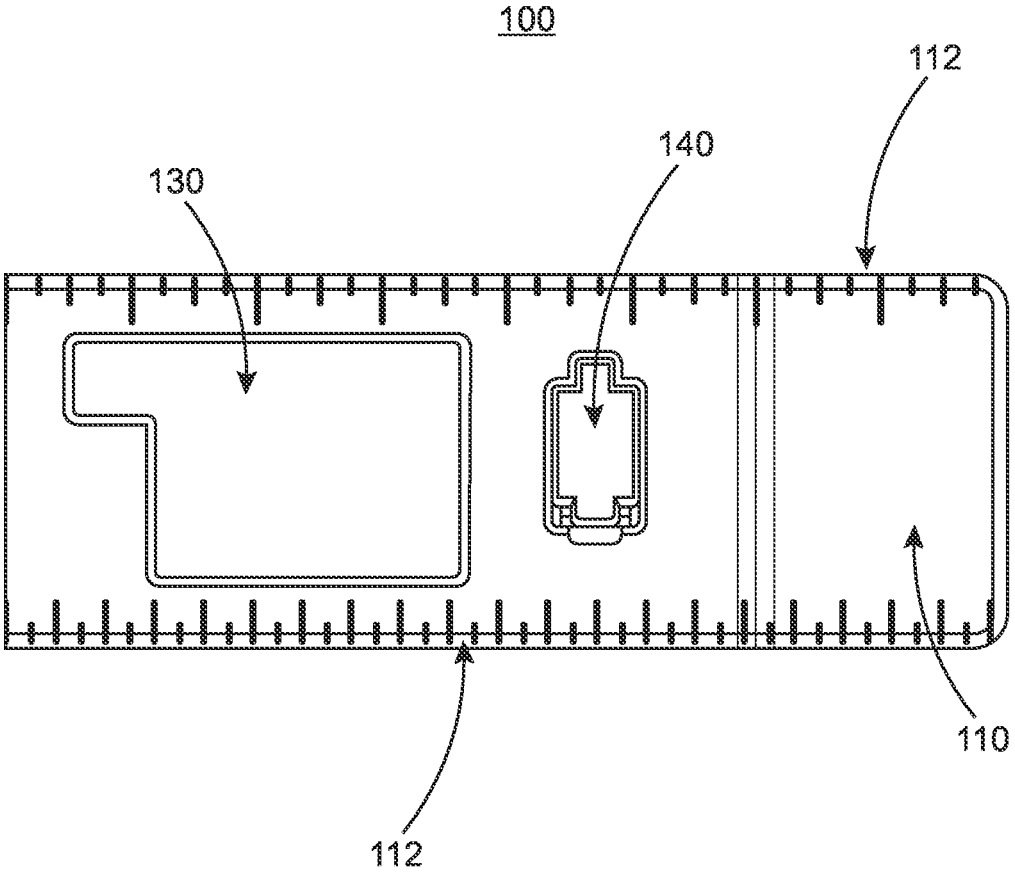
Figure 3:
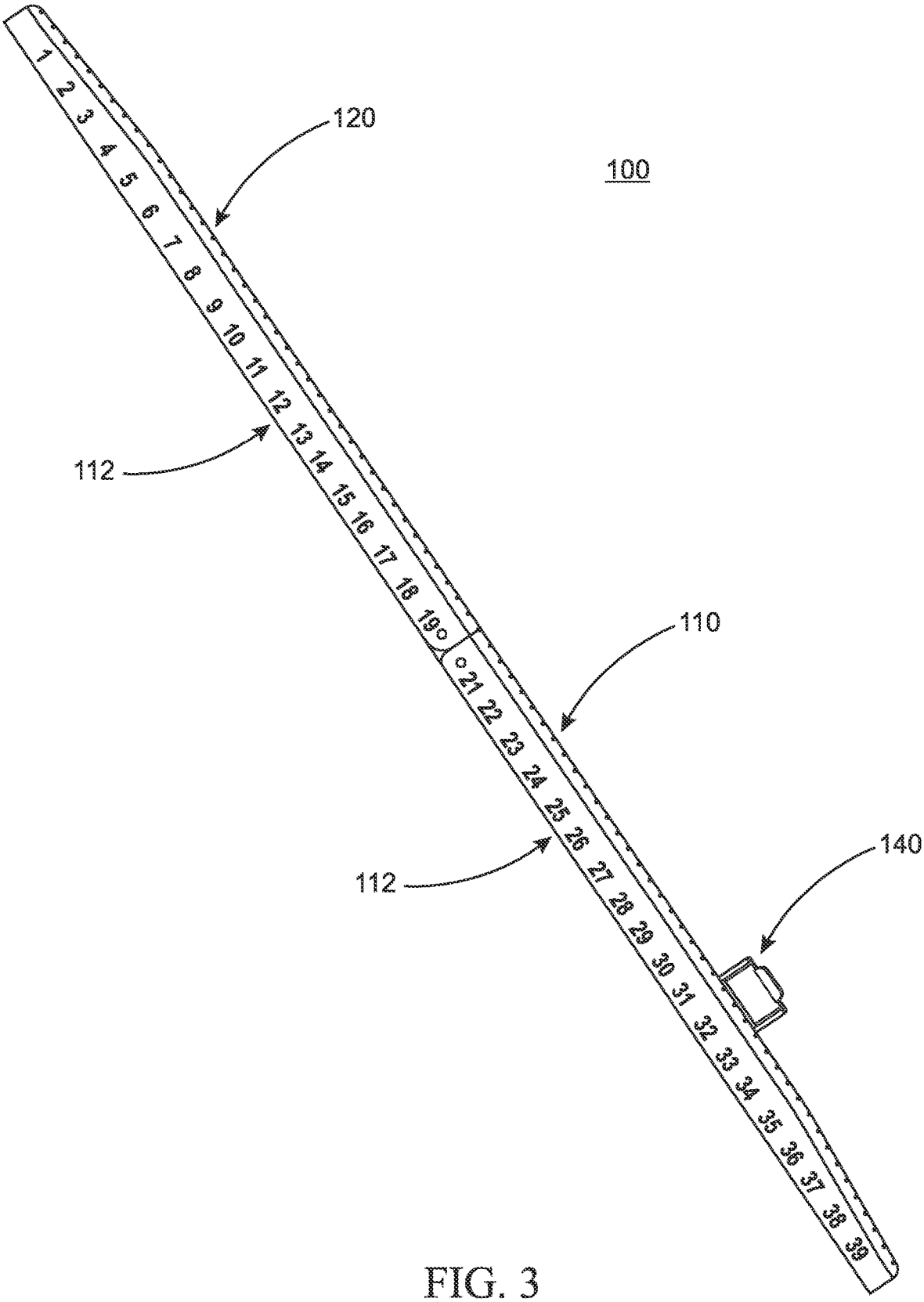
Figure 4:
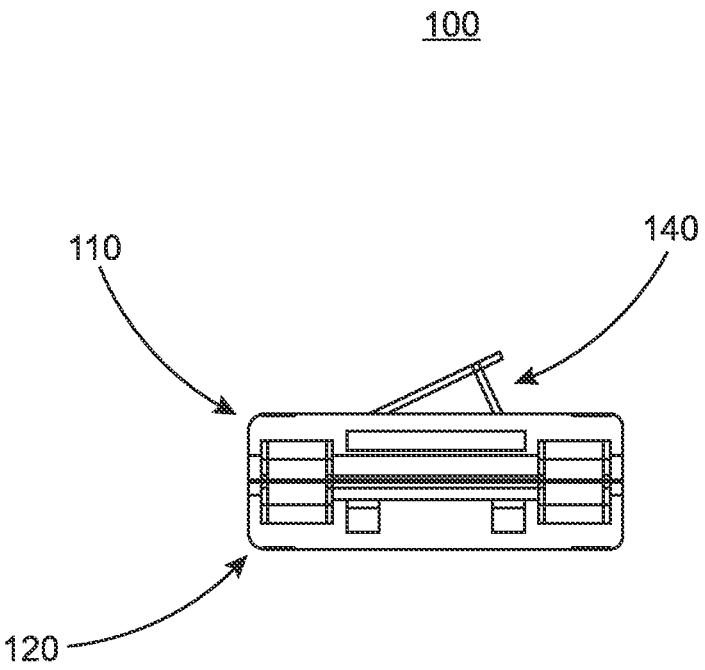
Figure 5:
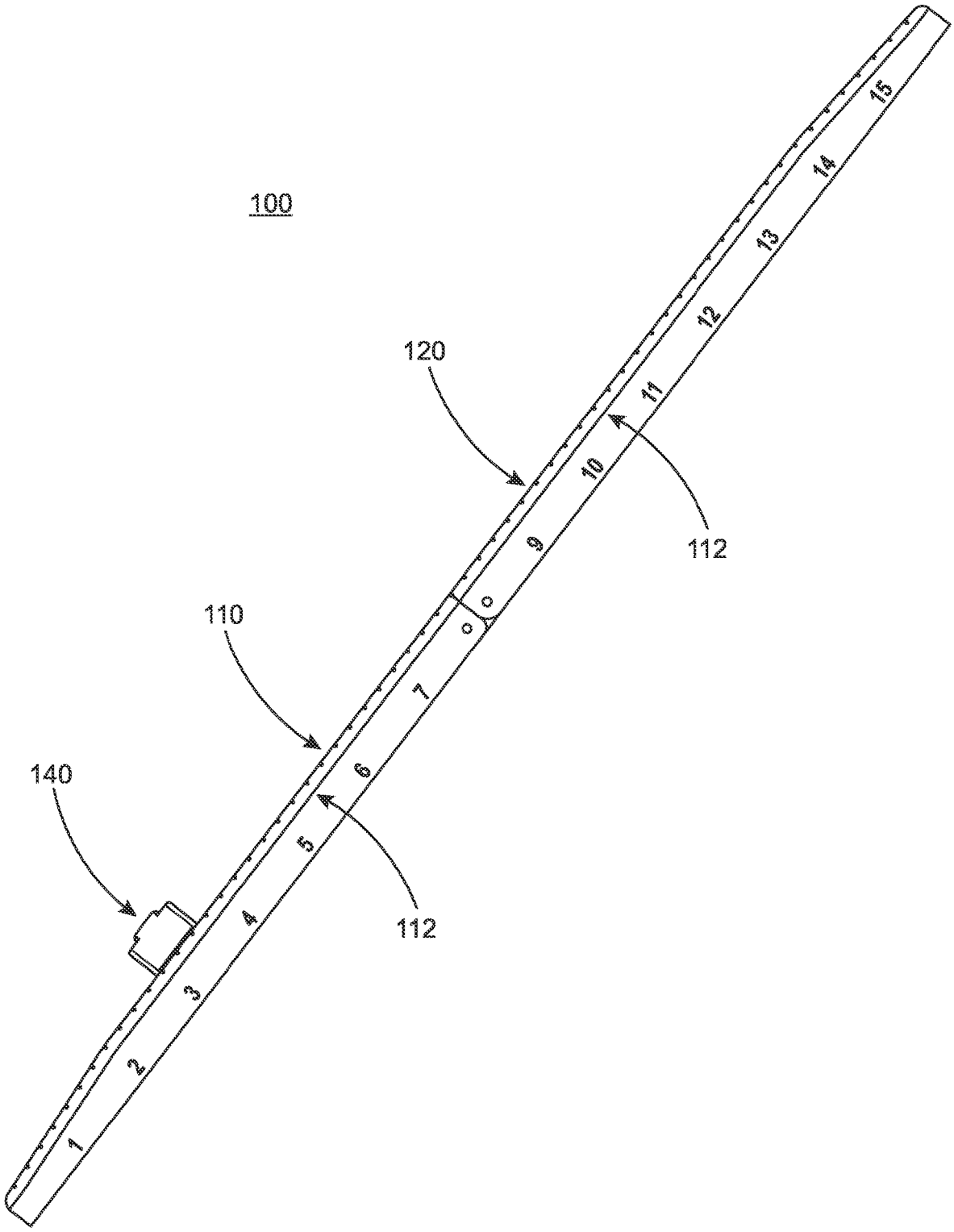
Figure 6:
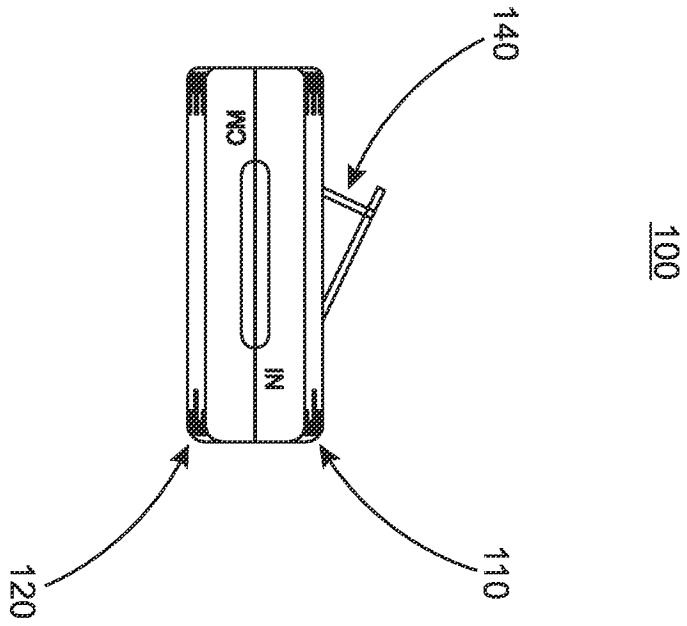
Figure 7:
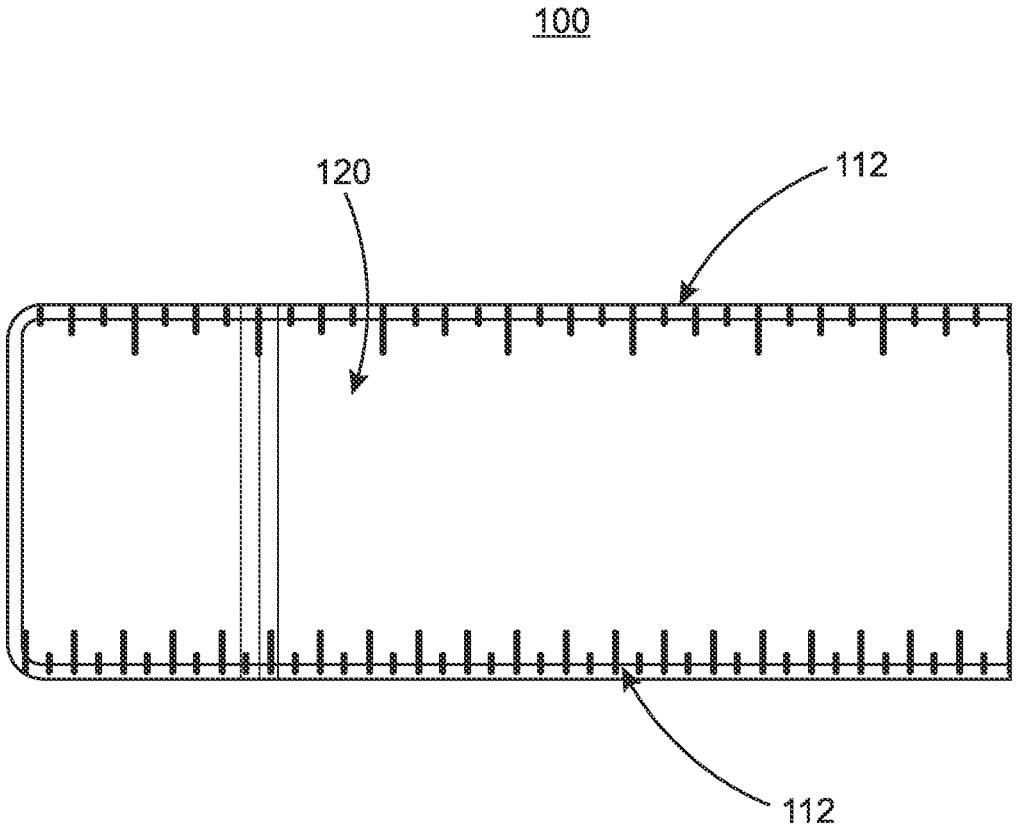
Figures 8, 8A:
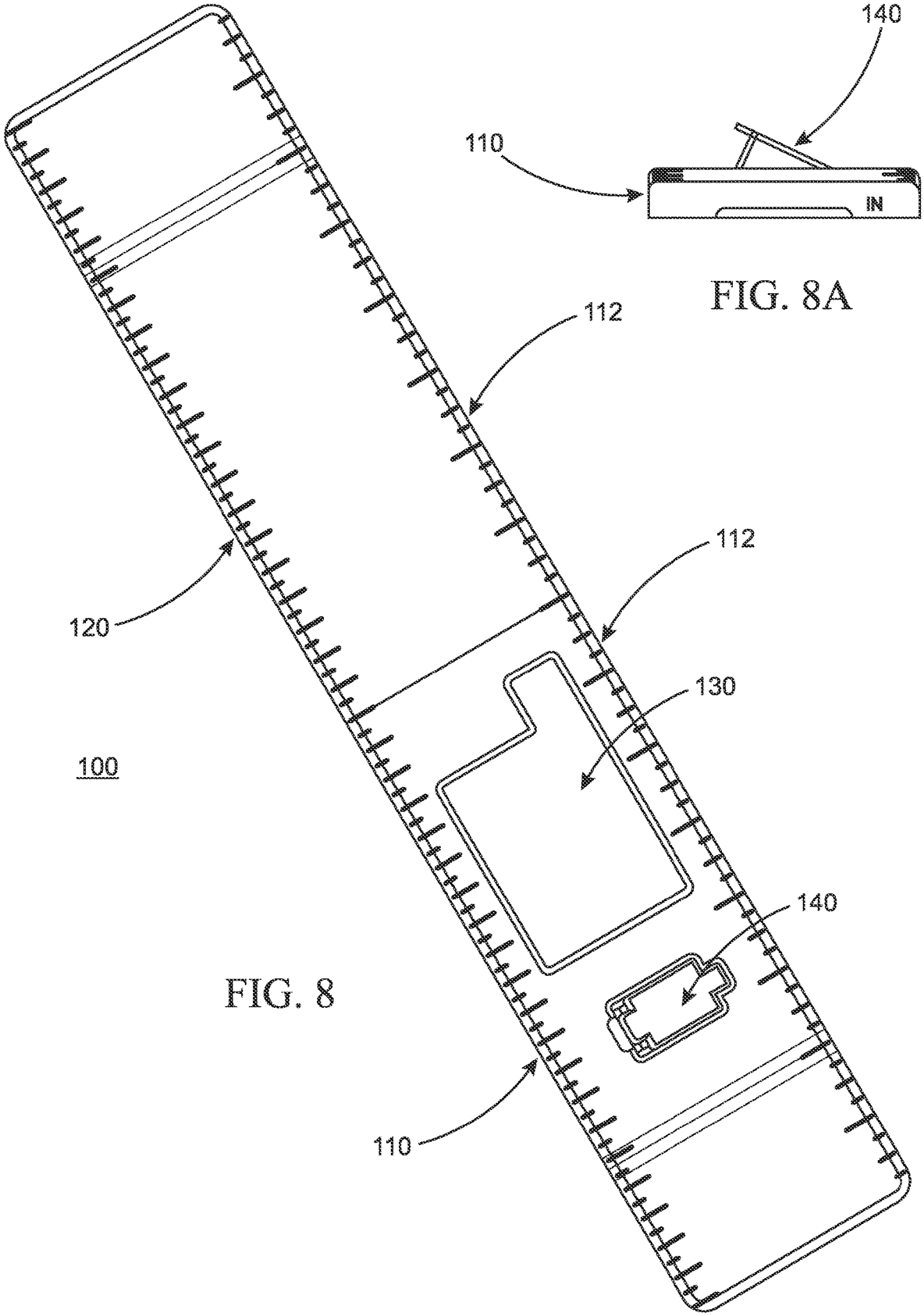
Figure 9:
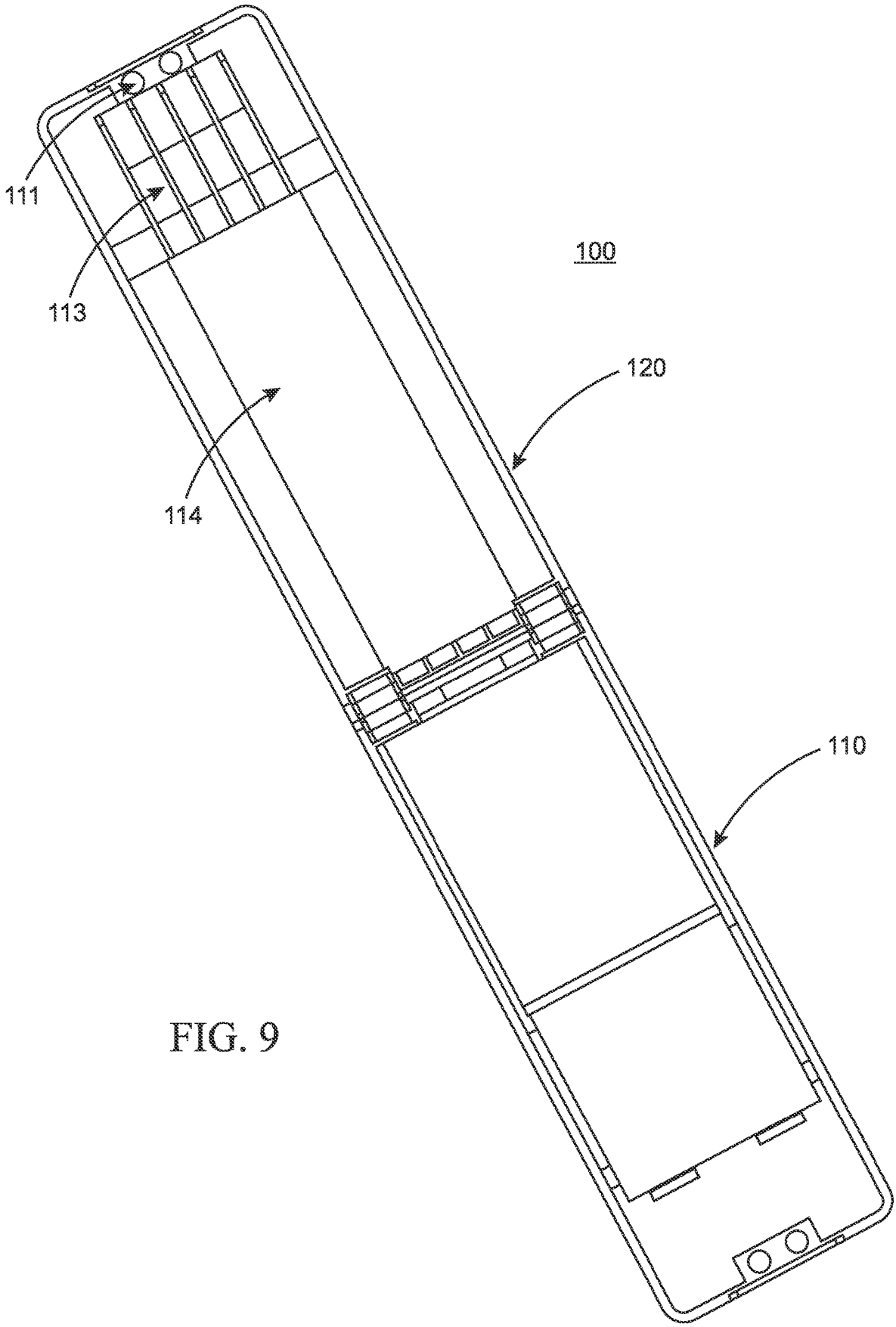

FIG. 1 presents a perspective view of a stationery system of the present invention when in a folding configuration;

FIG. 2 presents a top view of the stationery system of the present invention when in the folding configuration;

FIG. 3 presents a side view of the stationery system of the present invention when in an open configuration;

FIG. 4 presents an end view of the stationery system of the present invention when in a closing configuration;

FIG. 5 presents another perspective view of the stationery system of the present invention when in the open configuration;

FIG. 6 presents another end view of the stationery system of the present invention when in the closing configuration;

FIG. 7 presents a bottom view of the stationery system of the present invention when in the closing configuration;

FIG. 8 presents a top view of the stationery system of the present invention when in the open configuration;

FIG. 8A presents a view of the stationery system of the present invention when in the open configuration; and FIG. 9 presents a bottom view of the stationery system of the present invention when in the open configuration.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring initially to FIGS. 1-9, the present invention is directed toward a stationery system 100, and more particularly, to an all-in-one stationery system 100.

In an embodiment of the present invention, the stationery system 100 comprises a first cover 110 and a second cover 120.

In this embodiment of the present invention, the first cover 110 and the second cover 120 are rotatably connected with each other.

In this aspect of this embodiment of the present invention, a terminal end of the first cover 110 and a terminal of the second cover 120 are rotatably connected with each other via a hinge or a pin.

In this embodiment of the present invention, the stationery system 100 is selectively in an open configuration, a folding configuration and a closing configuration.

In this embodiment of the present invention, when the stationery system 100 is in the open configuration, the first cover 110 and the second cover 120 are straightly aligned with each other, another terminal end of the first cover 110 and another terminal of the second cover 120 are oppositely positioned to each other, such that the stationery system 100 can be used as an inch ruler or a metric ruler.

In this embodiment of the present invention, when the stationery system 100 is in the folding configuration, the first cover 110 and the second cover 120 are obliquely positioned to each other, another terminal end of the first cover 110 and another terminal of the second cover 120 are separate from each other.

In this embodiment of the present invention, when the stationery system 100 is in the closing configuration, the first cover 110 and the second cover 120 are folded over each other, another terminal end of the first cover 110 and another terminal of the second cover 120 are removably attached to and engaged with each other via any fasteners 111, such as magnets, such that the stationery system 100 can be used as a container with a chamber formed in between the first cover 110 and the second cover 120.

In this embodiment of the present invention, when the stationery system 100 is in the closing configuration, the stationery system 100 is rectangular in shape.

In this embodiment of the present invention, the first cover 110 and the second cover 120 each comprises marks and numbers 112 formed or printed on lateral sides and/or outer sides thereof.

In this embodiment of the present invention, the stationery system 100 can be used as a longer ruler when the stationery system 100 is in the open configuration compared with that the stationery system 100 can be used as a shorter ruler when the stationery system 100 is in the closing configuration.

In this embodiment of the present invention, at least one of the first cover 110 and the second cover 120 comprises at least one groove or cavity 113 formed on an inner side thereof, and the at least one groove or cavity 113 is used to accommodate pen(s), ink, pencil(s), lead(s), and eraser(s).

In this embodiment of the present invention, at least one of the first cover 110 and the second cover 120 further comprises at least one sheet or plate 114, and the at least one sheet or plate 114 removably covers the at least one groove or cavity 113.

In this embodiment of the present invention, at least one of the first cover 110 and the second cover 120 further comprises at least one fastening element (not shown), and the at least one fastening element is used to hold mechanical pen(s) and/or pencil(s) in place. For instance, the at least one fastening element may be a magnetic strip.

In this embodiment of the present invention, the stationery system 100 further comprises a calculator 130.

In this embodiment of the present invention, the calculator 130 is mounted on at least one of the first cover 110 and the second cover 120. For example, the calculator 130 may be mounted on the outer side of the first cover 110. The calculator 130 may be a programmable calculator which could shows the time, can be programmed to welcome a user when it is turned on, and/or can be programmed to input the user's name. In an aspect of this embodiment of the present invention, the calculator 130 may comprise a touch screen. In another aspect of the present invention, the calculator is removably attachable from either cover.

In this embodiment of the present invention, the stationery system 100 further comprises a sharpener 140, and the sharpener 140 is used to sharpen pencil(s).

In this embodiment of the present invention, the sharpener 140 is mounted on at least one of the first cover 110 and the second cover 120. For example, the sharpener 140 may be mounted on the outer side of the first cover 110. Alternatively, the sharpener 140 may traverse trough the outer side and the inner side of the first cover 110. In an aspect of this embodiment of the present invention, the sharpener 140 may comprise a sharpener holder, a sharpener tray and a sharpener mount.

Accordingly, the all-in-one stationery system 100 allows the user to have supplies, such as those needed in a classroom or an office, remain organized and handy when they are needed.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An all-in-one stationery system comprising:

a first cover rotatably connected to a second cover;

a calculator disposed on either the first cover or the second cover;

a sharpener disposed on either the first cover or the second cover, opposite where the calculator is disposed on, and where the sharpener traverses through an outer side to the inner side of the first cover or the second cover;

a ruler disposed on lateral sides of each the first cover and the second cover, where the ruler provides one or more marks and one or more numbers; and an attachment mechanism is disposed on a terminal end of the first cover and the second cover.

2. The all-in-one stationery system of claim 1, wherein when the stationery system is in an open configuration, the stationery system is configured to be used as an extended ruler.

3. The all-in-one stationery system of claim 1, wherein when the stationery system is in a closing configuration, the stationery system provides a container space for storing writing supplies.

4. The all-in-one stationery system of claim 1, wherein when the stationery system is in a closing configuration, the stationery system is configured to be used as a short ruler.

5. The all-in-one stationery system of claim 1, wherein the one or more marks and one or more numbers are formed or printed on lateral sides or outer sides of each the first cover and the second cover.

6. The all-in-one stationery system of claim 1, wherein at least one of the first cover and the second cover comprises at least one groove or cavity formed on an inner side thereof.

7. The all-in-one stationery system of claim 1, wherein the calculator is removably attachable to the first cover or the second cover.

8. The all-in-one stationery system of claim 1, wherein the calculator includes a touch screen.

9. The all-in-one stationery system of claim 8, wherein the calculator is programmable to execute one or more commands that include displaying a user's name on the touch screen of the calculator when the calculator is turned ON.

10. The all-in-one stationery system of claim 1, wherein the attachment mechanism comprises a set of magnets.

11. The all-in-one stationery system of claim 1, wherein an interior surface of the first cover includes one or more retaining tabs configured to retain a writing device within the retaining tabs.

12. The all-in-one stationery system of claim 1, wherein the first cover and the second cover are of equal length and size.

13. The all-in-one stationary system of claim 1, wherein the first cover and the second cover are rotatably fastened to each other with a hinge.

14. An all-in-one stationery system comprising:

a first cover rotatably connected to a second cover such that the all-in-one stationery is capable of being disposed of in a closed position or an open position;

a calculator disposed on either the first cover or the second cover;

a sharpener disposed on either the first cover or the second cover, opposite where the calculator is disposed on, and where the sharpener traverses through an outer side to the inner side of the first cover or the second cover, a ruler disposed on the first cover and the second cover, where the ruler provides one or more marks and one or more alphanumerical or alphabetical text on lateral sides of each the first cover and the second cover; and an attachment mechanism is disposed on a terminal end of the first cover and the second cover, wherein when the all-in-one stationery system is in a closed configuration, a bottom portion of the first cover mates with a bottom portion of the second cover to provide a container space for storing writing supplies.

15. The all-in-one stationery system of claim 14, wherein when the stationery system is in an open configuration, the first cover is adjacent to the second cover and the first cover and the second cover are configured to be used as an extended ruler.

16. The all-in-one stationery system of claim 14, wherein the one or more marks and one or more alphanumerical or alphabetical text are formed or printed on the lateral sides or outer sides of the first cover and the second cover.

17. The all-in-one stationery system of claim 14, wherein the calculator is removably attachable to the first cover or the second cover.

18. The all-in-one stationery system of claim 14, wherein the calculator includes a touch screen.

19. The all-in-one stationery system of claim 14, wherein an interior surface of the first cover includes one or more retaining tabs configured to retain a writing device within the retaining tabs.

20. An all-in-one stationery system comprising:

a first cover;

a second cover;

wherein the first cover and the second cover are rotatably connected and capable of being disposed of in a closed position or an open position;

an attachment mechanism disposed about a distal end of the first cover and the second cover to selectively maintain the all-in-one stationery in a closed position;

a calculator disposed on either the first cover or the second cover; and a sharpener disposed on either the first cover or the second cover, opposite where the calculator is disposed on, and where the sharpener traverses through an outer side to the inner side of the first cover or the second cover;

one or more retaining tabs disposed on an interior surface of the first cover or second cover, the tabs configured to retain a writing device thereon;

a ruler disposed on lateral sides of each the first cover and the second cover, where the ruler provides one or more marks and one or more numbers; and an attachment mechanism is disposed on a terminal end of the first cover and the second cover.

* * * * *